US005954481A

United States Patent [19]

Baier et al.

[11] Patent Number: 5,954,481

[45] Date of Patent: Sep. 21, 1999

[54] JET PUMP

[75] Inventors: Siegfried Baier, Reichshof; Peter Wenig, Diemelsee; David Noone, Marsberg, all of Germany

[73] Assignee: ITT Manufacturing Enterprises Inc., Wilmington, Del.

[21] Appl. No.: 08/930,751

[22] PCT Filed: Mar. 14, 1996

[86] PCT No.: PCT/EP96/01078

§ 371 Date: Nov. 17, 1997

§ 102(e) Date: Nov. 17, 1997

[87] PCT Pub. No.: WO96/31379

PCT Pub. Date: Oct. 10, 1996

[30] Foreign Application Priority Data

Mar. 14, 1996 [DE] Germany ..... PCT/EP96/07078

[51] Int. Cl.[6] ..... F04F 5/48

[52] U.S. Cl. ..... 417/182; 417/151; 417/197

[58] Field of Search ..... 417/151, 182, 417/192

[56] References Cited

U.S. PATENT DOCUMENTS

| | | | |
|---|---|---|---|
| 1,415,406 | 5/1922 | Scanes | 417/182 |
| 2,275,627 | 3/1942 | Hartman | 103/5 |
| 3,208,399 | 9/1965 | Keller | 103/270 |
| 4,019,834 | 4/1977 | Teodorescu | 417/84 |
| 4,759,691 | 7/1988 | Kroupa . | |

FOREIGN PATENT DOCUMENTS

| | | |
|---|---|---|
| 169526 | 7/1985 | European Pat. Off. . |
| 0 189 709 | 8/1986 | European Pat. Off. . |
| 4344624 | 6/1994 | Germany . |
| 43 10 761 | 10/1994 | Germany . |

*Primary Examiner*—Timothy S. Thorpe
*Assistant Examiner*—Ehud Gartenberg
*Attorney, Agent, or Firm*—Rader, Fishman & Grauer PLLC

[57] ABSTRACT

A jet pump includes a sucking jet pump with a flow duct having a decreasing cross section and a suction pipe insert which is inserted therein, a bypass arrangement and a valve arrangement, which form a construction unit, where the sucking jet pump has a nozzle insert which is inserted in a duct, which forms the flow duct with decreasing cross section.

15 Claims, 2 Drawing Sheets

JET PUMP

BACKGROUND OF THE INVENTION

The present invention relates to a jet pumps, particularly for the operation of a vacuum brake booster of a motor vehicle.

Such jet pumps are used in a brake booster system with a vacuum brake booster to increase the vacuum in the brake booster connected with a underpressure generator. In known systems of this type, a sucking jet pump is used in a suction line leading from the brake booster to a underpressure generator, to reinforce, if needed, the suction performance of the underpressure generator. For this purpose, the underpressure generator is connected at its outlet to a feed connection piece which is located laterally with respect to the flow direction at the sucking jet pump. By the addition of the pressurized outlet air of the pressure generator to the sucking jet pump, the flow in the latter is accelerated and more vacuum is generated. In order to prevent a pressure equilibration between the underpressure generator and the volume of the brake booster, a return valve arrangement is provided between the brake booster and the sucking jet pump.

From German Patent DE 43 10 761, a jet pump is known, in which the return valve arrangement is connected in one construction unit directly to the sucking jet pump. For this purpose, the sucking jet pump is constructed as a single part with a bypass made of a synthetic material and fitted with a valve arrangement provided with a feed connection piece. If the suction performance of the sucking jet pump is to be varied, then a new construction unit must be constructed in its entirety.

The object of the present invention therefore is to propose a jet pump which can be adapted, without extensive effort, to different suction performances. Furthermore, the manufacture of the jet pump should be cost advantageous, while simultaneously preserving a high functionality.

SUMMARY OF THE INVENTION

This object is achieved by a sucking jet pump presenting a nozzle insert which is inserted in a duct, and which forms the flow duct with decreasing cross section.

The use of a nozzle insert in which the cross section decreases in the direction of the flow duct, makes it possible, with an otherwise unchanged sucking jet pump, to incorporate nozzle inserts having different suction jet duct cross sections, and thus to build, in a cost-effective manner, a multitude of different jet pumps with high performance. The use of the same external dimensions of the jet pump with different performance types simplifies the construction of the space for incorporation, in which the jet pump is to be used, for example, the engine space in a motor vehicle.

If the nozzle insert is a separate exchangeable component, then it is possible to use cost effective parts, rather than expensive parts made of expensive materials, which are guaranteed to be operational for the entire lifespan. It is possible to perform maintenance on the jet pump. In that process, simple components, such as the nozzle insert, can be replaced, and it is not necessary to replace the entire pump.

In this context it is advantageously possible to design the nozzle insert and the suction pipe insert as a preassembled unit, with mutual adaptation to each other, which can be inserted into the housing of the jet pump. However, it is also possible to insert the two parts separately.

In this context, at least one of the inserts (suction pipe inserts and/or nozzle inserts) is connected with positive locking to the duct, in which it is or they are inserted. This can advantageously be achieved by using a corresponding insert which presents projections and/or recesses which engage in corresponding recesses or with corresponding projections formed in the duct. The insert can thus be attached by a latching or clipping mechanism.

If the duct, in which the nozzle insert is applied, is cylindrical or unilaterally conical, then it does not present a narrowed section or only one narrowed section at the end, and consequently it is possible to manufacture the jet pump using the injection molding procedure with a single molding core arranged on one side, because the duct does not broaden again after a narrow section, which would require an additional mold core, arranged on the other side.

Furthermore, the invention provides a valve arrangement which is a separate component. This simplifies the assembly of the valves, because they are thus more easily accessible. Furthermore, this also makes replacement easy, either for maintenance or for the use of different valves for different performance requirements.

If the valve arrangement is located on one side on a cover of the jet pump and on the other side at the sucking jet pump, then mechanical stresses of the cover and an attachment connected to it cannot have any negative effect on the valve unit; for example, in the case of damage to the cover or the connection, it is not necessary to replace the entire valve unit. The valve unit can here be applied at the duct or directly at the suction pipe insert used in the duct, and it can be sealed against the latter.

It is preferred to use simple O rings for the mutual sealing of the cover, the valve arrangement and the sucking jet pump. O rings are simple to handle, functional and cost effective. The use of adhesives, which are usually used to prevent leaks in the seal, can thus be omitted. If the sealing surfaces are designed appropriately, it is also possible completely omit sealing elements.

Furthermore, the seat surface of the return valve, which covers the duct which receives the valve unit, is perpendicular with respect to the longitudinal axis of the duct, and the circular ring which surrounds the seat surface is applied in a sealing manner directly to the frontal surface of the duct or with an additional component inserted. This arrangement of the flat surface of the seal seat perpendicularly to the axis of the duct results in an optimal sealing effect, because the force is applied perpendicularly to the sealing plane without horizontal components.

If the feed connection piece arranged at the end of the housing located downstream is molded immediately at the housing, the resulting advantage is that the housing needs to be fitted with a cover on only one side, which makes a lateral assembly possible.

The individual components of the jet pump, particularly the cover and the housing, can be connected to each other either with positive locking, for example, by means of a clip connection, or by means of an adhesive connection.

It is preferred to use a welded connection, for example, by means of friction welding, ultrasound welding or another procedure familiar to a person skilled in the art. Welding connections can be made in a rapid, simple and clean manner. The use of additional sealing elements can be omitted. In addition, the result of this approach is that the jet pump cannot be dismantled. This is advantageous in case it is necessary to rule out an undesired manipulation by the final user of the finished product, and represents a safetyrelated component. Such a situation exists when the jet pump is used in the brake system of a motor vehicle.

According to the invention, a metal ring is provided between the cover and the housing, which makes it possible to make an induction welding connection.

Additional advantages of the invention will be apparent in the following description made with reference to the drawing.

DETAILED DESCRIPTION OF THE INVENTION

Figure 1:
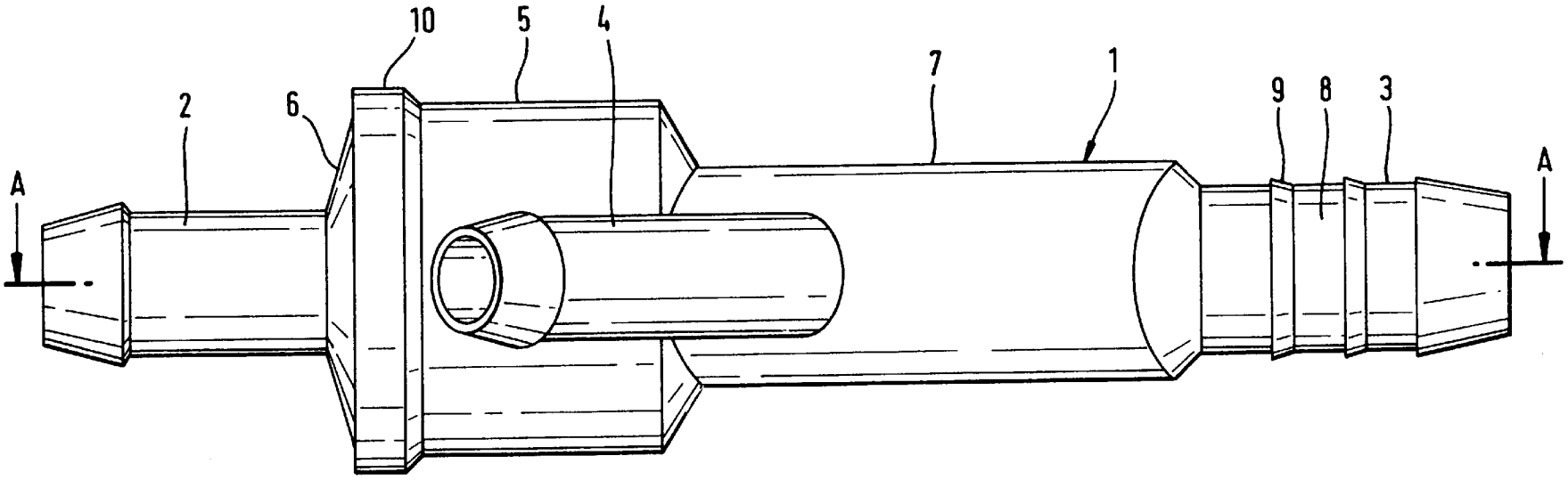
FIG. 1 represents an external view of a jet pump according to the invention.

FIG. 1 shows an external view of the housing 1 of the jet pump according to the invention. The vacuum chamber of a brake booster which is not shown is connected to the vacuum connection 2, and a vacuum source is connected to the vacuum connection 3. The pressure connection 4 is connected to a pressure source. The pressure source or the vacuum source can here be arranged upstream or downstream with respect to the throttle valve of the combustion engine.

The housing 1 consists of a cylindrical part to one end of which a cover 6 is attached, where the vacuum connection 2 is formed so as to be one piece with the cover. The cylindrical part, on the other hand, undergoes a modification to a narrowed section 7, with respect to the plane of the drawing of FIG. 1. A feed connection piece 8, forming the vacuum connection 3, is molded on section 7, with which it forms one piece. For a reliable connection, the feed connection piece 8 is provided with a flexible hose having several barbs 9.

Figure 2:
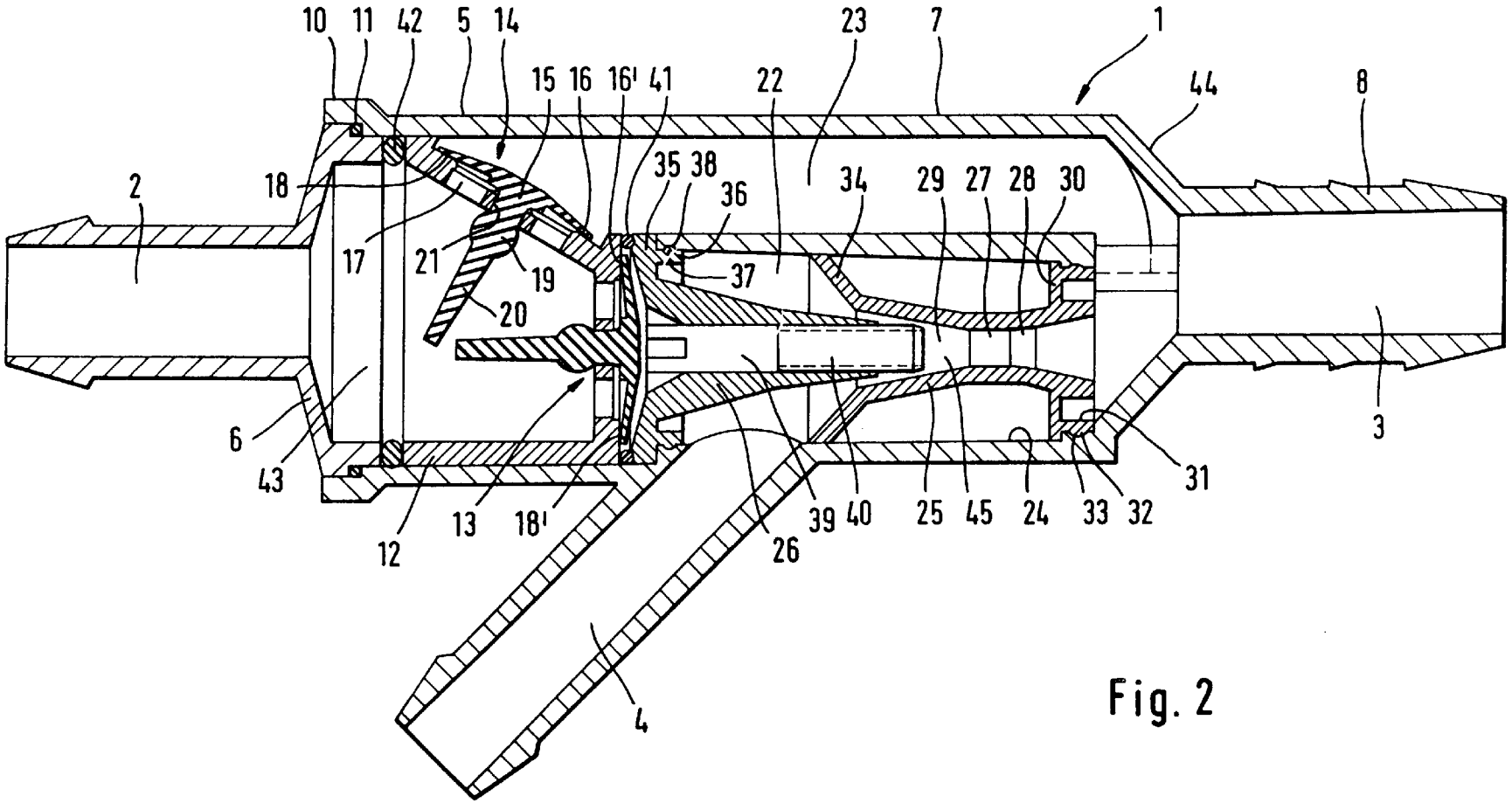
FIG. 2 represents a jet pump according to the invention in section along line A—A of FIG. 1.

FIG. 2 shows the jet pump of FIG. 1 in a longitudinal section along line A—A. The cover 6 is pressed into a radial broadening 10 of the housing 1. It can also be clipped in or screwed in. Between the broadening 10 and the cover 6, a metal ring 11 is arranged, which makes it possible to weld using the induction welding procedure.

In the cylindrical part 5, the valve arrangement 12 is located. It has a first valve 13 and a second valve 14, each of which have a mushroom-shaped valve plug 15 and a seat surface 16. The seat surface 16 is provided with several bores 17, which are surrounded by a circular ring 18, against which the edge of the valve plug 15 is applied, forming a seal. To open the valve 13 or 14, the external area of the valve peg 15 is lifted up away from the circular ring 18. Air can now flow through the bores 17 past the valve plug 15. The valve plug 15 is attached by means of a rod 20 with a broadening 19 in a central bore of the seat surface.

In the narrowed section 7, the sucking jet pump 22 and the bypass arrangement 23 are formed. The sucking jet pump 22 is located in a pipe-shaped duct 24, and the bypass arrangement 23 presents an approximately sickle-shaped cross section. A nozzle insert 25 and a suction pipe insert 26 are inserted into the duct 24. The nozzle insert 25 has an approximately cylindrical central area 27, which undergoes a bilateral modification to form funnel-shaped broadenings. The broadening 28 is provided with a radially projecting ring 30, from which tabs 31 project axially, the tabs being provided with projections 32. The projections 32 engage in recesses on the internal circumference of the underpressure, connection-side, end of the duct 24. The nozzle insert 25 can thus be attached by a latching in the duct 24. The broadening 29 undergoes a modification to a funnel-shaped end section 34, which is applied against the internal wall of the duct 24. The suction pipe connection 26 presents a flat end area 35, which is provided with axially projecting tabs 36, which engage by means of projections 37 into recesses 38 of the duct 24. From the end area 35 on, the suction pipe insert becomes narrower, in the shape of a funnel. A bore 39 is formed in its interior, and a suction pipe 40 is provided at its end, which extends into the funnel-shaped broadening 29.

In the area of the suction pipe insert 26, the pressure connection 4 opens into the duct 24. Between the end area 35 and the seat surface 16', an O ring 41 is provided, and an O ring 42 is provided between the valve arrangement 12 and the cover 6. The sealing rings 41, 42 seal off the underpressure space 43, connected to the vacuum connection 2, with respect to the bypass arrangement 23 and the external space. The narrowed section 7 also presents an additional narrowed area 44, which leads into the feed connection piece 8.

The steel pump according to the invention operates as follows: When a pressure is applied to the vacuum connection 4, which is higher than the pressure in the pressure connection 3, the air flows from the pressure connection 4 in the external area of the suction pipe insert 26 into the nozzle insert 25, through the flow duct 45 which is formed within nozzle insert, and into the vacuum connection 3. In this process, in the narrow section between the suction pipe 40 and the funnel-shaped broadening 29, a high flow velocity is reached, resulting in the generation of a vacuum in the suction pipe 40. This vacuum leads to the opening of the first valve 13 and to a reduction of the pressure in the underpressure space 43. A vacuum forms in the latter. The first valve 13 closes, as soon as this vacuum is "better" than that in the suction pipe 40, thus preventing a worsening of this vacuum.

If there is no pressure difference between the vacuum connection 3 and the pressure connection 4, or if this pressure difference is so small that flow velocity cannot be reached which is sufficiently high so that a vacuum is obtained in the suction pipe 40, then the first valve 13 remains closed. As long as the pressure in the underpressure space 43 is greater than in the bypass arrangement 21, the second valve 14 is open, otherwise it closes. The bypass arrangement 23 guarantees a high flow medium cross section for the case when the sucking jet pump 22 cannot contribute to the pressure reduction in the underpressure space 43.

We claim:

1. A jet pump with a sucking jet pump comprising:

a housing;

a flow duct located in the housing and having a decreasing cross section;

a nozzle insert located in the flow duct;

a suction pipe insert inserted in the flow duct and having one end in a first suction volume in the flow duct;

a sucked fluid conduit connected to the housing and including an underpressure space;

a valve arrangement associated with the sucked fluid conduit for controlling a sucked fluid flow, the valve arrangement including a first valve for controlling the sucked fluid flow to the nozzle insert and a second valve for controlling the sucked fluid flow to a bypass arrangement ending in a second suction volume; and wherein the valve arrangement is located upstream from the first and second suction volumes and the second suction volume is downstream of the first suction volume.

2. The jet pump according to claim 1, wherein the nozzle insert is a separate component.

3. The jet pump according to claim 2, wherein the nozzle is exchangeable.

4. The jet pump according to claim 1, wherein the nozzle insert and the suction pipe insert form a preassembled unit.

5. The jet pump according to claim 1, wherein at least one of the inserts is connected with positive locking to the duct.

6. The jet pump according to claim 5, wherein at least one of the inserts and the duct are connected to each other by projections and recesses which are in engagement.

7. The jet pump according to claim 1, wherein the duct, into which the nozzle insert is inserted, has a cylindrical shape.

8. The jet pump according to claim 7, wherein the housing includes a cover and a cylindrical part that are glued to each other.

9. The jet pump according to claim 7, wherein the housing includes a cover and a cylindrical part that are welded to each other.

10. The jet pump according to claim 9, wherein a metal ring is arranged between the cover and the cylindrical part.

11. The jet pump according to claim 1, wherein the valve arrangement is a separate component.

12. The jet pump according to claim 11, wherein the valve arrangement is applied, on one side, against a cover of the jet pump and, on the other side, against the sucking jet pump.

13. The jet pump according to claim 12, wherein the cover, the valve arrangement and the sucking jet pump are mutually sealed by means of simple O-rings.

14. The jet pump according to claim 1, wherein a seat surface of a first valve is perpendicular with respect to the longitudinal axis of the duct, and a circular ring which surrounds the seat surface is applied so it forms a seal against a frontal surface of the duct.

15. The jet pump according to claim 1, wherein a feed connection piece, which is arranged at the jet pump housing downstream of the jet pump, is molded directly at the housing.

* * * * *